US010634414B2

(12) United States Patent
Li

(10) Patent No.: US 10,634,414 B2
(45) Date of Patent: Apr. 28, 2020

(54) METHOD FOR OPERATING A FAN WITHIN A REFRIGERATOR APPLIANCE

(71) Applicant: General Electric Company, Schenectady, NY (US)

(72) Inventor: Jianwu Li, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1004 days.

(21) Appl. No.: 14/987,043

(22) Filed: Jan. 4, 2016

(65) Prior Publication Data

US 2017/0191733 A1 Jul. 6, 2017

(51) Int. Cl.

| | |
|---|---|
| ***F25D 21/02*** | (2006.01) |
| ***F25D 21/00*** | (2006.01) |
| ***F25D 29/00*** | (2006.01) |
| ***F25D 21/08*** | (2006.01) |

(52) U.S. Cl.

CPC ..... *F25D 21/02* (2013.01); *F25D 21/008* (2013.01); *F25B 2700/21174* (2013.01); *F25D 21/08* (2013.01); *F25D 29/005* (2013.01); *F25D 2317/0681* (2013.01)

(58) Field of Classification Search

CPC ..... F25D 21/08; F25D 21/006; F25D 2323/00284; F25D 2317/0681

See application file for complete search history.

(56) References Cited

U.S. PATENT DOCUMENTS

| | | | | | |
|---|---|---|---|---|---|
| 3,453,837 | A * | 7/1969 | Ting | F25D 21/006 | 62/140 |
| 4,327,556 | A * | 5/1982 | Zampini | F25D 21/006 | 62/153 |
| 4,346,564 | A * | 8/1982 | Gemma | F25D 21/02 | 62/140 |
| 4,834,169 | A * | 5/1989 | Tershak | F25D 17/065 | 165/233 |
| 5,003,786 | A * | 4/1991 | Fudono | F25D 21/002 | 62/126 |
| 5,666,816 | A * | 9/1997 | Jeong | F25D 21/002 | 62/154 |
| 5,673,565 | A * | 10/1997 | Jeong | F25D 21/006 | 62/152 |
| 5,842,355 | A * | 12/1998 | Kalis | F25D 17/062 | 62/234 |
| 6,205,800 | B1 * | 3/2001 | Topper | A47F 3/0404 | 62/128 |
| 6,319,114 | B1 * | 11/2001 | Nair | B01D 46/0086 | 165/80.3 |
| 6,694,754 | B1 * | 2/2004 | Schenk | F25D 21/006 | 62/156 |

(Continued)

FOREIGN PATENT DOCUMENTS

| | | |
|---|---|---|
| CN | 102141334 A | 8/2011 |
| EP | 2 757 335 A1 | 7/2014 |

(Continued)

*Primary Examiner* — Nelson J Nieves

(74) *Attorney, Agent, or Firm* — Dority & Manning, P.A.

(57) ABSTRACT

A method for operating a fan within a refrigerator appliance includes initiating a defrost cycle of the refrigerator appliance, monitoring an output of a temperature sensor of the fan during the defrost cycle, and terminating the defrost cycle when the output of the temperature sensor reaches or exceeds a threshold temperature.

14 Claims, 5 Drawing Sheets

(56) References Cited

U.S. PATENT DOCUMENTS 8,997,507 B2 * 4/2015 Boarman ..... F25D 21/14 62/150
2001/0047657 A1 * 12/2001 Cho ..... F25D 11/022 62/156
2007/0033962 A1 * 2/2007 Kang ..... F25B 5/04 62/441
2007/0119193 A1 * 5/2007 Davis ..... F25C 5/046 62/135
2009/0090114 A1 * 4/2009 Choo ..... F25D 21/006 62/80
2010/0218528 A1 * 9/2010 Yakumaru ..... F25B 47/022 62/234
2010/0223947 A1 * 9/2010 Shibuya ..... B60H 1/3223 62/323.3
2010/0326096 A1 * 12/2010 Junge ..... F25D 17/065 62/82
2011/0185755 A1 * 8/2011 Kim ..... F25D 21/02 62/155
2012/0031985 A1 * 2/2012 Do ..... G05D 23/1928 236/46 A
2012/0219399 A1 * 8/2012 Suzuki ..... G06F 1/206 415/1
2013/0081416 A1 * 4/2013 Kim ..... F25D 21/006 62/151
2013/0098078 A1 * 4/2013 Contreras Lafaire ... F25D 21/06 62/82
2013/0127210 A1 * 5/2013 Jung ..... A47C 7/744 297/180.12
2014/0137580 A1 * 5/2014 Peyaud ..... F25B 41/04 62/80
2014/0150477 A1 * 6/2014 Qu ..... F25B 47/02 62/80
2015/0184924 A1 * 7/2015 Vie ..... F25D 21/004 62/80
2015/0219385 A1 * 8/2015 Harlen ..... F25D 21/08 62/80
2016/0024606 A1 * 1/2016 Mori ..... F25D 3/10 165/109.1
2016/0123649 A1 * 5/2016 Ahn ..... F25D 21/08 62/80
2017/0176084 A1 * 6/2017 Iwamoto ..... F25D 21/002
2017/0184333 A1 * 6/2017 Lukasse ..... B60H 1/321

FOREIGN PATENT DOCUMENTS

GB 700284 A * 11/1953 ..... F25D 21/008
GB 1239223 A * 7/1971 ..... F25D 21/002

* cited by examiner

METHOD FOR OPERATING A FAN WITHIN A REFRIGERATOR APPLIANCE

FIELD OF THE INVENTION

The present subject matter relates generally to refrigerator appliances and methods for running defrost cycles in refrigerator appliances.

BACKGROUND OF THE INVENTION

Refrigerators generally include a cabinet that defines a chilled chamber. The chilled chamber is commonly cooled with a sealed system having an evaporator. One problem frequently encountered with modem refrigerators is inefficient defrosting of the evaporator. For example, when the evaporator is active, frost can accumulate on the evaporator and thereby reduce efficiency of the evaporator. One effort to reduce or eliminate frost from the evaporator has been to utilize a heater, such as an electric heater, to heat the evaporator when the evaporator is not operating.

Defrosting the evaporator to completely remove frost buildup from the evaporator is difficult. Certain defrost cycles operate for a predetermined period of time. However, the predetermined period of time may be too short. Over time, ice can build up and accumulate on the evaporator, and the ice can eventually block air flow around the evaporator and negatively affect an efficiency of the evaporator. When the ice reaches a cooling fan, the ice can obstruct the fan's blades causing the fan to generate an irritating high pitch noise.

Accordingly, a method for operating a fan of a refrigerator appliance that assists with activating and/or terminating a defrost cycle of the refrigerator appliance would be useful. In addition, a method for operating a fan of a refrigerator appliance that assists with determining when ice obstructs the fan would be useful.

BRIEF DESCRIPTION OF THE INVENTION

The present subject matter provides a method for operating a fan within a refrigerator appliance. The method includes initiating a defrost cycle of the refrigerator appliance, monitoring an output of a temperature sensor of the fan during the defrost cycle, and terminating the defrost cycle when the output of the temperature sensor reaches or exceeds a threshold temperature. Additional aspects and advantages of the invention will be set forth in part in the following description, or may be apparent from the description, or may be learned through practice of the invention.

In a first exemplary embodiment, a method for operating a fan within a refrigerator appliance is provided. The fan includes a temperature sensor positioned proximate an impeller of the fan. The method includes initiating a defrost cycle of the refrigerator appliance, monitoring an output of the temperature sensor of the fan during the defrost cycle, and terminating the defrost cycle when the output of the temperature sensor reaches a threshold temperature.

In a second exemplary embodiment, a method for operating a fan within a refrigerator appliance is provided. The fan includes a temperature sensor positioned proximate an impeller of the fan. The method includes initiating a defrost cycle when a temperature measurement of the temperature sensor of the fan is less than the freezing temperature of water for a predetermined period of time, monitoring the temperature measurement of the temperature sensor of the fan during the defrost cycle, and terminating the defrost cycle when the temperature measurement of the temperature sensor exceeds a threshold temperature.

In a third exemplary embodiment, a refrigerator appliance is provided. The refrigerator appliance includes a casing that defines a chilled chamber. A fan is disposed within the casing. The fan includes a motor. An impeller is coupled to the motor such that the impeller is rotatable with the motor. A control hoard is in operative communication with the motor. A temperature sensor is positioned on the control board.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
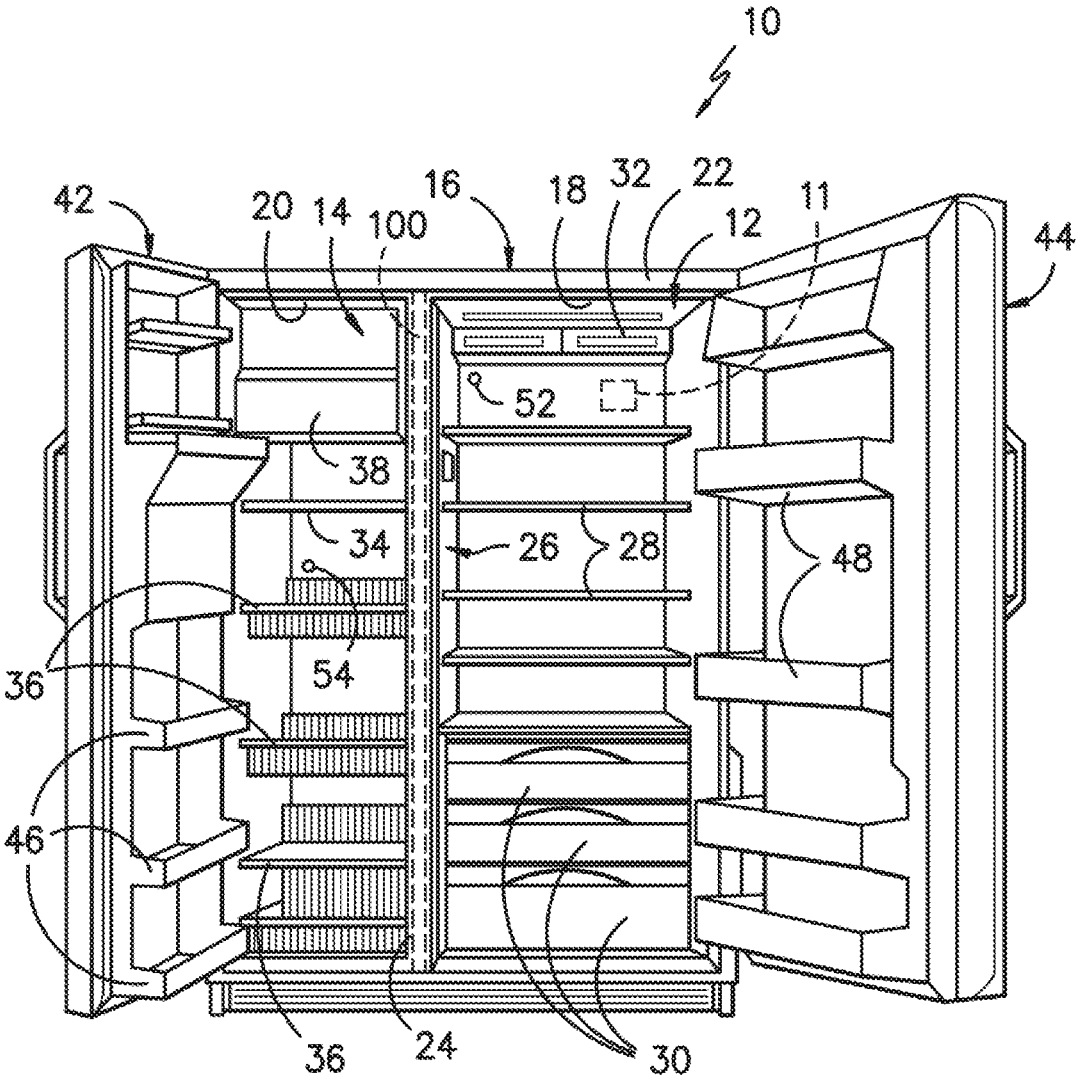
FIG. 1 provides a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front view of a representative refrigerator appliance 10 according to an exemplary embodiment of the present invention. More specifically, for illustrative purposes, the present invention is described with a refrigerator appliance 10 having a construction as shown and described further below. As used herein, a refrigerator appliance includes appliances such as a refrigerator/freezer combination, side-by-side, bottom mount, compact, and any other style or model of refrigerator appliance. Accordingly, other configurations including multiple and different styled compartments could be used with refrigerator appliance 10, it being understood that the configuration shown in FIG. 1 is by way of example only.

Refrigerator appliance 10 includes a fresh food storage compartment 12 and a freezer storage compartment 14. Freezer compartment 14 and fresh food compartment 12 are arranged side-by-side within an outer case 16 and defined by inner liners 18, 20 therein. A space between case 16 and liners 18, 20 and between liners 18, 20 is filled with foamed-in-place insulation. Outer case 16 normally is formed by folding a sheet of a suitable material, such as pre-painted steel, into an inverted U-shape to form the top and side walls of case 16. A bottom wall of case 16 normally is formed separately and attached to the case side walls and to a bottom frame that provides support for refrigerator appliance 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel.

A breaker strip 22 extends between a case front flange and outer front edges of liners 18, 20. Breaker strip 22 is formed from a suitable resilient material, such as an extruded acrylo-butadiene-styrene based material (commonly referred to as ABS). The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26. In addition, refrigerator appliance 10 includes shelves 28 and slide-out storage drawers 30, sometimes referred to as storage pans, which normally are provided in fresh food compartment 12 to support items being stored therein.

Refrigerator appliance 10 can be operated by one or more controllers 11 or other processing devices according to programming and/or user preference via manipulation of a control interface 32 mounted, e.g., in an upper region of fresh food storage compartment 12 and connected with controller 11. Controller 11 may include one or more memory devices and one or more microprocessors, such as a general or special purpose microprocessor operable to execute programming instructions or micro-control code associated with the operation of the refrigerator appliance. The memory may represent random access memory such as DRAM, or read only memory such as ROM or FLASH. In one embodiment, the processor executes programming instructions stored in memory. The memory may be a separate component from the processor or may be included onboard within the processor.

Controller 11 may be positioned in a variety of locations throughout refrigerator appliance 10. In the illustrated embodiment, controller 11 may be located e.g., behind an interface panel 32 or doors 42 or 44. Input/output ("I/O") signals may be routed between the control system and various operational components of refrigerator appliance 10 along wiring harnesses that may be routed through e.g., the back, sides, or mullion 26. Typically, through user interface panel 32, a user may select various operational features and modes and monitor the operation of refrigerator appliance 10. In one embodiment, the user interface panel may represent a general purpose I/O ("GPIO") device or functional block. In one embodiment, the user interface panel 32 may include input components, such as one or more of a variety of electrical, mechanical or electro-mechanical input devices including rotary dials, push buttons, and touch pads. The user interface panel 32 may include a display component, such as a digital or analog display device designed to provide operational feedback to a user. User interface panel 32 may be in communication with controller 11 via one or more signal lines or shared communication busses.

In one exemplary embodiment of the present invention, one or more temperature sensors are provided to measure the temperature in the fresh food compartment 12 and the temperature in the freezer compartment 14. For example, first temperature sensor 52 may be disposed in the fresh food compartment 12 and may measure the temperature in the fresh food compartment 12. Second temperature sensor 54 may be disposed in the freezer compartment 14 and may measure the temperature in the freezer compartment 14. This temperature information can be provided, e.g., to controller 11 for use in operating refrigerator 10. Temperature measurements from first and second temperature sensors 52, 54 may be taken intermittently or continuously during operation of refrigerator appliance 10.

A shelf 34 and wire baskets 36 are also provided in freezer compartment 14. In addition, an ice maker 38 may be provided in freezer compartment 14. A freezer door 42 and a fresh food door 44 close access openings to freezer and fresh food compartments 14, 12, respectively. Each door 42, 44 is mounted to rotate about its outer vertical edge between an open position, as shown in FIG. 1, and a closed position (not shown) closing the associated storage compartment. In alternative embodiments, one or both doors 42, 44 may be slidable or otherwise movable between open and closed positions. Freezer door 42 includes a plurality of storage shelves 46, and fresh food door 44 includes a plurality of storage shelves 48.

Figure 2:
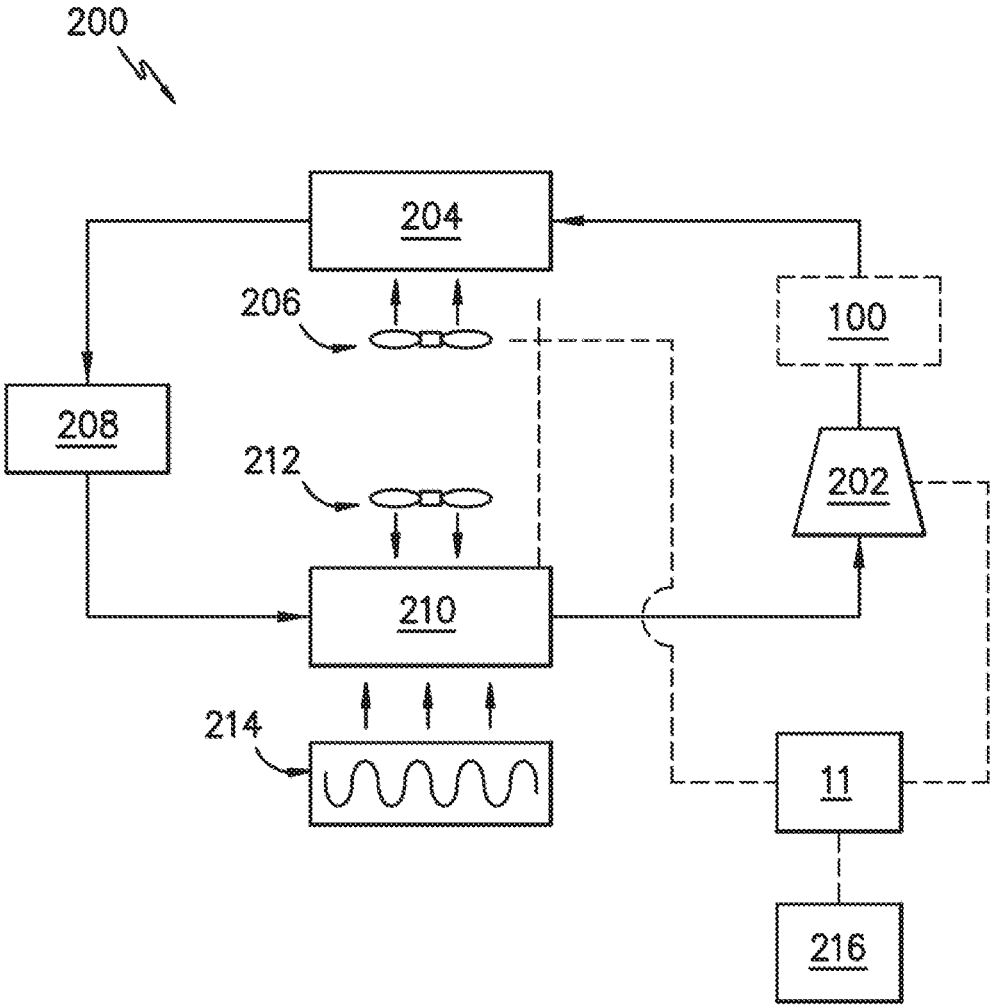
FIG. 2 provides a schematic view of various components of a refrigeration system of the exemplary refrigerator appliance of FIG. 1.

Referring now to FIG. 2, refrigerator appliance 10 may include a refrigeration system 200. In general, refrigeration system 200 is charged with a refrigerant that is flowed through various components and facilitates cooling of the fresh food compartment 12 and the freezer compartment 14. Refrigeration system 200 may be charged or filled with any suitable refrigerant.

Refrigeration system 200 includes a compressor 202 for compressing the refrigerant, thus raising the temperature and pressure of the refrigerant. Compressor 202 may for example be a variable speed compressor, such that the speed of the compressor 202 can be varied between zero (0) and one hundred (100) percent by controller 11. Refrigeration system 200 may further include a condenser 204, which may be disposed downstream of compressor 202, e.g., in the direction of flow of the refrigerant. Thus, condenser 204 may receive refrigerant from the compressor 202, and may condense the refrigerant by lowering the temperature of the refrigerant flowing therethrough due to, e.g., heat exchange with ambient air. A condenser fan 206 may be used to force air over condenser 204 as illustrated to facilitate heat exchange between the refrigerant and the surrounding air. Condenser fan 206 can be a variable speed fan meaning the speed of condenser fan 206 may be controlled or set anywhere between and including, e.g., zero (0) and one hundred (100) percent. The speed of condenser fan 206 can be determined by, and communicated to, fan 206 by controller 11.

Refrigeration system 200 further includes an evaporator 210 disposed downstream of the condenser 204. Additionally, an expansion device 208 may be utilized to expand the refrigerant, thus further reduce the pressure of the refrigerant, leaving condenser 204 before being flowed to evaporator 210. Evaporator 210 generally is a heat exchanger that transfers heat from air passing over the evaporator 210 to refrigerant flowing through evaporator 210, thereby cooling the air and causing the refrigerant to vaporize. An evaporator fan 212 may be used to force air over evaporator 210 as illustrated. As such, cooled air is produced and supplied to refrigerated compartments 12, 14 of refrigerator appliance 10. In one exemplary embodiment of the present invention, evaporator fan 212 can be a variable speed evaporator fan meaning the speed of evaporator fan 212 may be controlled or set anywhere between and including, e.g., zero (0) and one hundred (100) percent. The speed of evaporator fan 212 can be determined by, and communicated to, evaporator fan 212 by controller 11.

Evaporator 210 may be in communication with fresh food compartment 12 and freezer compartment 14 to provide cooled air to compartments 12, 14. Alternatively, refrigeration system 200 may include two or more evaporators, such that at least one evaporator provides cooled air to fresh food compartment 12 and at least one evaporator provides cooled air to freezer compartment 14. In other embodiments, evaporator 210 may be in communication with any suitable component of the refrigerator appliance 10. For example, in some embodiments, evaporator 210 may be in communication with ice maker 38, such as with an ice compartment of the ice maker 38. From evaporator 210, refrigerant may flow back to and through compressor 202, which may be downstream of evaporator 210, thus completing a closed refrigeration loop or cycle.

As shown in FIG. 2, a defrost heater 214 may be utilized to defrost evaporator 210, i.e., to melt ice that accumulates on evaporator 210. Heater 214 may be positioned adjacent (e.g., below) evaporator 210 within fresh food compartment 12 and/or freezer compartment 14. Heater 214 may be activated periodically; that is, a period of time $t_{ice}$ elapses between when heater 214 is deactivated and when heater 214 is reactivated to melt a new accumulation of ice on evaporator 210. The period of time $t_{ice}$ may be a preprogrammed period such that time $t_{ice}$ is the same between each period of activation of heater 214, or the period of time may vary. Alternatively, heater 214 may be activated based on some other condition, such as the temperature of evaporator 210 or any other appropriate condition, as discussed in greater detail below.

Refrigeration system 200 also includes a temperature sensor 216. Temperature sensor 216 may be any suitable temperature sensor. For example, temperature sensor 216 may be a thermistor, a thermocouple, a resistance thermometer, etc. Temperature sensor 216 may be used to monitor the temperature of air from or about evaporator 210. Thus, temperature sensor 216 may be positioned at or adjacent (e.g., above) evaporator 210 and/or heater 214. Measurements from temperature sensor 216 may be utilized to initiate and/or terminate a defrost cycle of refrigeration system 200. Thus, compressor 202 and defrost heater 214 may activated and deactivated in response to measurements from temperature sensor 216. In some embodiments, temperature sensor 216 may send an output or signal to controller 11. Thus, temperature sensor 216 may be in operative communication with controller 11.

Figure 3:
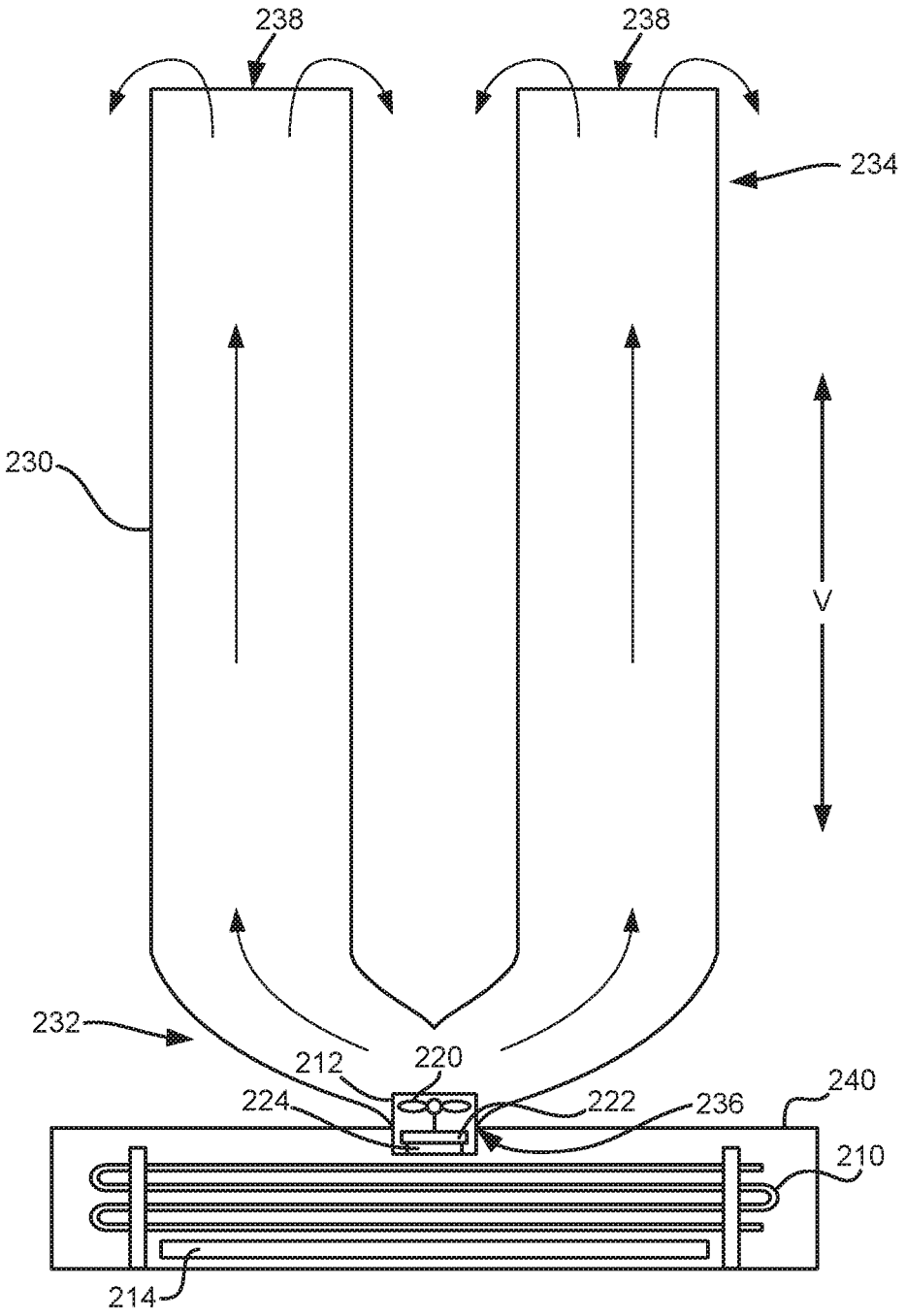
FIG. 3 provides another schematic view of various components of the refrigeration system of the exemplary refrigerator appliance of FIG. 1.

FIG. 3 provides another schematic view of various components of refrigeration system 200. As shown in FIG. 3, refrigeration system 200 may include an air duct 230. Air duct 230 extends between a top portion 234 and a bottom portion 232, e.g., along a vertical direction V. Thus, bottom and top portions 232, 234 of air duct 230 may be spaced apart from each other along the vertical direction V. Air duct 230 also extends between an inlet 236 and at least one outlet 238. Inlet 236 is positioned at or adjacent evaporator 210. Thus, air duct 230 is configured for receiving chilled air from evaporator 210 at inlet 236 of air duct 230. Outlets 238 are configured for directing the chilled air out of air duct 230. As an example, air duct 230 may be mounted to one of inner liners 18, 20 at fresh food storage compartment 12 or freezer compartment 14. Thus, outlets 238 of air duct 230 may be contiguous with fresh food storage compartment 12 or freezer compartment 14 in order to direct the chilled air from evaporator 210 to fresh food storage compartment 12 or freezer compartment 14. A cover plate 240 may be positioned over evaporator 210, e.g., such that the cover plate 240 is disposed between evaporator 210 and fresh food storage compartment 12 or freezer compartment 14.

Evaporator fan 212 may be positioned at or adjacent inlet 236 of air duct 230, e.g., at or adjacent bottom portions 232 of air duct 230. Thus, evaporator fan 212 may draw chilled air from evaporator 210 into air duct 230 at inlet 236 of air duct 230 and urge the chilled air through air duct 230 to outlets 238. Evaporator fan 212 may include an impeller 220, a motor 222 and a control board 224. Impeller 220 may be coupled to motor 222, e.g., with a shaft that extends between motor 222 and impeller 220. Thus, motor 222 is configured for selectively rotating impeller 220. Impeller 220 may include a plurality of blades (not shown) that are positioned and oriented for drawing air through evaporator fan 212 during operation of motor 222. Control board 224 may be a printed circuit board (PCB) that includes various electrical components for enabling operation of motor 222, e.g., such that motor 222 rotates impeller 220 at various speeds. Thus, control board 224 may be configured for operating motor 222 as a variable speed motor.

As discussed above, temperature sensor 216 (FIG. 2) may be used to monitor the temperature of air from or about evaporator 210. In particular, temperature sensor 216 may be integrated within evaporator fan 212 such that temperature sensor 216 is positioned proximate impeller 220. In such a manner, temperature sensor 216 may be exposed to air drawn by impeller 220 into air duct 230 at inlet 236 of air duct 230, and temperature sensor 216 may measure the temperature of air entering air duct 230 at inlet 236 of air duct 230. In addition, as discussed in greater detail below, integrating temperature sensor 216 within evaporator fan 212 may assist with initiating and terminating a defrost cycle of refrigerator appliance 10, e.g., such that evaporator 210 fully defrosts.

Temperature sensor 216 may be mounted to or integrated in evaporator fan 212 at any suitable location on evaporator fan 212. For example, temperature sensor 216 may be positioned on control board 224. In particular, temperature sensor 216 may be a thermistor or thermocouple disposed on control board 224. Thus, temperature sensor 216 may be mounted to motor 222 or another static portion of evaporator fan 212, e.g., such that temperature sensor 216 does not rotate during operation of evaporator fan 212. By providing temperature sensor 216 on control board 224, temperature sensor 216 may be integrated into evaporator fan 212 in a cost effective manner.

Figure 4:
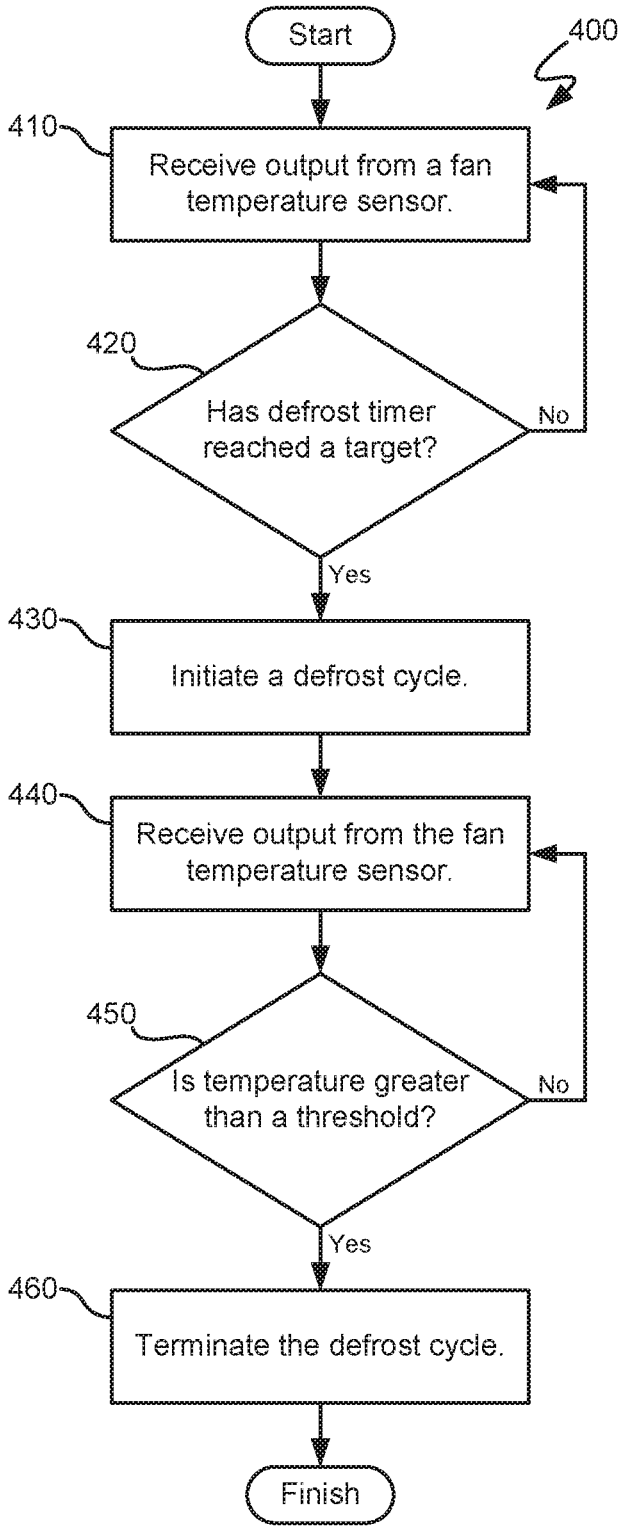
FIG. 4 illustrates a method for operating a fan during a defrost cycle of a refrigerator appliance according to an exemplary embodiment of the present subject matter.

FIG. 4 illustrates a method 400 for operating a fan during a defrost cycle of a refrigerator appliance according to an exemplary embodiment of the present subject matter. Method 400 may be used to operate a fan within any suitable refrigerator appliance. For example, method 400 may be used in or with evaporator fan 212 of refrigeration system 200, and controller 11 may be programmed or configured to implement method 400. Thus, method 400 is discussed in greater detail in the context of refrigerator appliance 10. Method 400 may assist with initiating and terminating a defrost cycle of refrigerator appliance 10, e.g., such that evaporator 210 fully defrosts.

At step 410, controller 11 receives an output temperature measurement from temperature sensor 216 at evaporator fan 212. Thus, controller 11 may monitor the temperature of air at evaporator fan 212 at step 410. Evaporator fan 212 may be activated or deactivated at step 410. For example, evaporator fan 212 may be turned on at step 410 such that evaporator fan 212 draws chilled air from evaporator 210 into air duct 230 at inlet 236 of air duct 230.

At step 420, controller 11 may determine if a defrost timer has reached a target time. If the defrost tinier has not reached the target time, then controller 11 loops back to step 410 and continues to monitor the temperature of air at evaporator fan 212. Conversely, method 400 continues to step 430 if the defrost timer has reached the target time. The target time may be any suitable time interval, e.g., no less than one hour, no less than five hours, no less than ten hours, no less than fifteen hours, etc.

At step 420, controller 11 may also determine whether the output temperature measurement from temperature sensor 216 at step 410 is less than freezing, i.e., less than thirty-two degrees Fahrenheit (32° F.) or zero degrees Celsius (0° C.). If the output temperature measurement from temperature sensor 216 is not less than freezing at step 410, then controller 11 loops back to step 410 and continues to monitor the temperature of air at evaporator fan 212. Conversely, method 400 continues to step 430 if the output temperature measurement from temperature sensor 216 is less than freezing at step 420. When the output temperature measurement from temperature sensor 216 is less than freezing at step 420, ice and frost may cover evaporator 210, and the ice and frost on evaporator 210 may cool air drawn into air duct 230 with evaporator fan 212 to less than freezing.

Step 420 may include determining whether the output temperature measurement from temperature sensor 216 is less than freezing for a predetermined period of time, e.g., ten seconds, thirty seconds, one minute, etc. Thus, method 400 may require multiple output temperature measurements from temperature sensor 216 below freezing to continue to step 430 from step 420.

At step 430, controller 11 initiates a defrost cycle. The defrost cycle assists with removing frost and ice from evaporator 210 in order to improve performance of evaporator 210. During the defrost cycle, controller 11 may deactivate compressor 202 and/or activate heater 214. By deactivating compressor 202, cooling of evaporator 210 by refrigerant within refrigeration system 200 may be reduced or limited. Similarly, activating heater 214 may heat and melt the ice and frost on evaporator 210. As another example, refrigerant flow within refrigeration system 200 may be reversed in order to heat evaporator 210 with refrigerant within evaporator 210. In such a manner, the defrost cycle may remove ice and frost from evaporator 210.

At step 440, controller 11 again receives the output temperature measurement from temperature sensor 216 at evaporator fan 212. Thus, controller 11 may monitor the temperature of air at evaporator fan 212 during the defrost cycle. Evaporator fan 212 may be deactivated at step 440, e.g., during the defrost cycle. For example, evaporator fan 212 may be turned off at step 440 such that evaporator fan 212 does not draws warm air from evaporator 210 into air duct 230 at inlet 236 of air duct 230.

At step 450, controller 11 determines whether the output temperature measurement from temperature sensor 216 at step 450 is greater than a threshold temperature. The threshold temperature may be any suitable temperature, e.g., greater than thirty-two degrees Fahrenheit (32° F.). For example, the threshold temperature may be about thirty-five degrees Fahrenheit (35° F.), about forty degrees Fahrenheit (40° F.), about forty-five degrees Fahrenheit (45° F.), etc. As used herein, the term "about" means within five degrees of the stated temperature when used in the context of temperatures. Thus, controller 11 determines whether the output temperature measurement from temperature sensor 216 at step 450 is greater than freezing at step 450.

If the output temperature measurement from temperature sensor 216 is not greater than the threshold temperature at step 450, then controller 11 loops back to step 440 and continues to monitor the temperature of air at evaporator fan 212. Conversely, method 400 continues to step 460 if the output temperature measurement from temperature sensor 216 is greater than the threshold temperature at step 440. When the output temperature measurement from temperature sensor 216 is greater than the threshold temperature at step 440, ice and frost may absent from evaporator 210 such that evaporator 210 is fully defrosted. In particular, with evaporator fan 212 turned off, output temperature measurements from temperature sensor 216 may remain less than the threshold temperature until frost and ice proximate evaporator fan 212 melts. Thus, monitoring output temperature measurements from temperature sensor 216 may assist with determining when evaporator 210 is defrosted.

Step 440 may include determining whether the output temperature measurement from temperature sensor 216 is greater than the threshold temperature for a predetermined period of time, e.g., ten seconds, thirty seconds, one minute, etc. Thus, method 400 may require multiple output temperature measurements from temperature sensor 216 greater than the threshold temperature to continue to step 460 from step 450.

At step 460, controller 11 terminates the defrost cycle. Controller 11 may activate compressor 202 and evaporator fan 212 and/or deactivate heater 214 at step 460. In such a manner, the defrost cycle may be terminated after removing ice and frost from evaporator 210.

Figure 5:
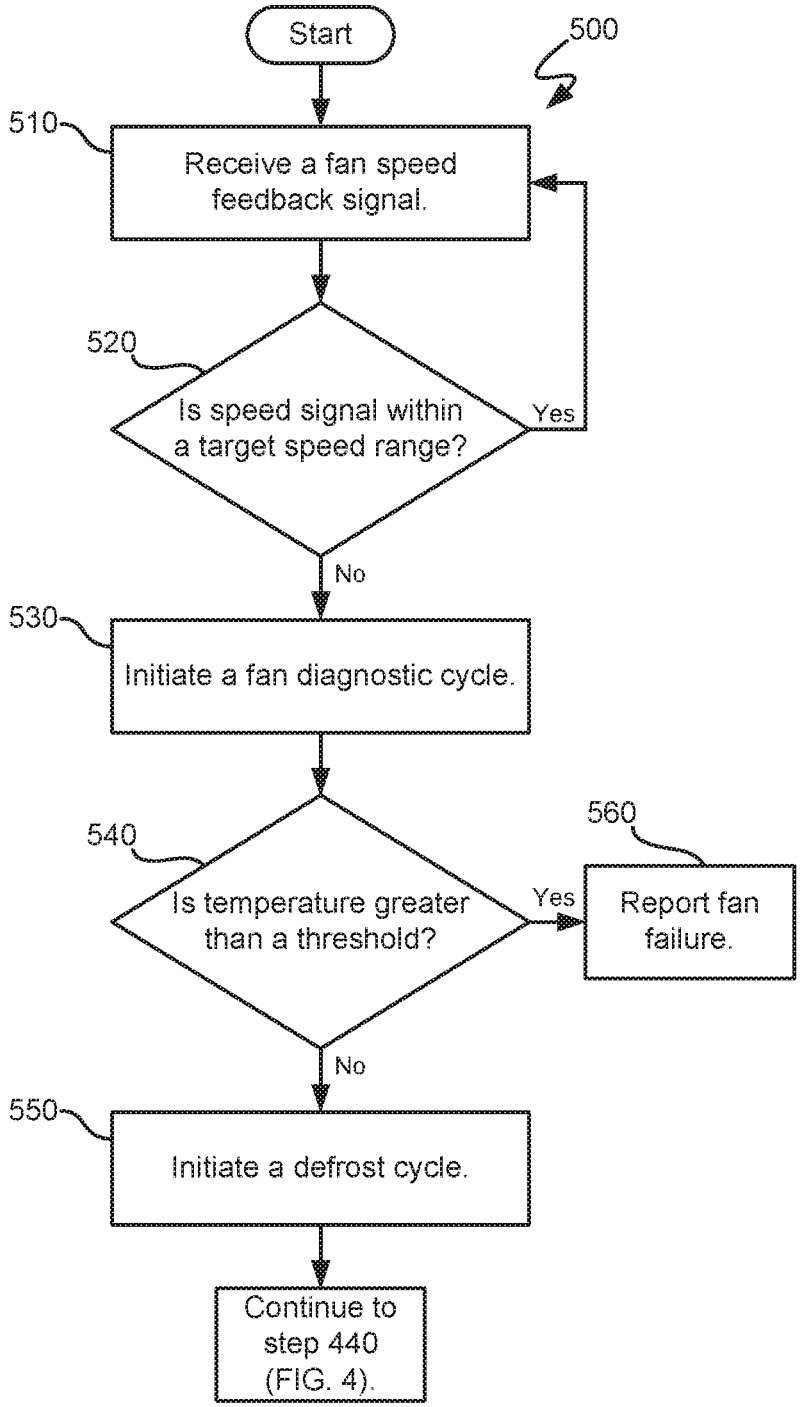
FIG. 5 illustrates a method for diagnosing a fan of a refrigerator appliance according to an exemplary embodiment of the present subject matter.

FIG. 5 illustrates a method 500 for diagnosing a fan of a refrigerator appliance according to an exemplary embodiment of the present subject matter. Method 500 may be used to operate a fan within any suitable refrigerator appliance. For example, method 500 may be used in or with evaporator fan 212 of refrigeration system 200, and controller 11 may be programmed or configured to implement method 500. Thus, method 500 is discussed in greater detail in the context of refrigerator appliance 10. Method 500 may be implemented during method 400.

Method 500 may assist with determining whether evaporator fan 212 is inoperative. As an example, controller 11 may determine that evaporator fan 212 is inoperative at step 560 if the output temperature measurement from temperature sensor 216 is greater than freezing at step 540 and a speed of evaporator fan 212 from step 510 is less than a threshold speed at step 520. The threshold speed may be any suitable speed. For example, the threshold speed may be one thousand rotations per minute, five thousand rotations per minute, etc. When the output temperature measurement from temperature sensor 216 is greater than freezing at step 540, evaporator fan 212 may be ice free. In turn, when evaporator fan 212 is ice free and still fails to operate at the threshold speed at step 520, controller 11 may determine that evaporator fan 212 is defective (e.g., and in need of servicing or replacement) at step 560. Conversely method 500 may continue to method 400 at step 550 when evaporator fan 212 is operating properly, as shown in FIG. 5. In such a manner, method 500 may assist with monitoring an operational status of evaporator fan 212.

While described above in the context of evaporator fan 212 at fresh food compartment 12, it should be understood that method 400 may be used with any other suitable fan within refrigerator appliance 10. For example, method 400 may be used to operate a fan at freezer compartment 14 and/or an ice box of refrigerator appliance 10, e.g., in order to regulate a defrost cycle of an evaporator at such portions of refrigerator appliance 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a fan within a refrigerator appliance, the fan comprising a temperature sensor positioned proximate an impeller of the fan such that the temperature sensor is exposed to air drawn by the impeller, the method comprising:

initiating a defrost cycle of the refrigerator appliance;

monitoring an output of the temperature sensor of the fan during the defrost cycle;

terminating the defrost cycle in response to the output of the temperature sensor reaching a threshold temperature; and determining that the fan is defective in response to the output of the temperature sensor being greater than a freezing temperature of water and a speed of the fan being less than a threshold speed, wherein the fan further comprises a motor coupled to the impeller and a control board in operative communication with the motor, the temperature sensor positioned on the control board of the fan.

2. The method of claim 1, wherein the temperature sensor comprises a thermistor.

3. The method of claim 1, wherein the refrigerator appliance further comprises an evaporator and a defrost heating element, the fan positioned adjacent at least one of the evaporator or the defrost heating element.

4. The method of claim 3, wherein said step of terminating the defrost cycle of the refrigerator appliance comprises deactivating the defrost heating element.

5. The method of claim 3, wherein said step of initiating the defrost cycle of the refrigerator appliance comprises terminating a flow of refrigerant through the evaporator.

6. The method of claim 1, wherein the motor of the fan is deactivated during said step of monitoring.

7. The method of claim 1, wherein said step of initiating comprises initiating the defrost cycle of the refrigerator appliance when the output of the temperature sensor of the fan is less than the freezing temperature of water for a predetermined period of time prior to said step of initiating.

8. The method of claim 1, wherein the fan is positioned at a fresh food chamber, a freezer chamber or an ice box of the refrigerator appliance.

9. A method for operating a fan within a refrigerator appliance, the fan comprising a temperature sensor positioned proximate an impeller of the fan such that the temperature sensor is exposed to air drawn by the impeller, the method comprising:

initiating a defrost cycle when a temperature measurement of the temperature sensor of the fan is less than a freezing temperature of water for a predetermined period of time;

monitoring the temperature measurement of the temperature sensor of the fan during the defrost cycle; and terminating the defrost cycle in response to the temperature measurement of the temperature sensor exceeding a threshold temperature; and determining that the fan is defective in response to the temperature measurement of the temperature sensor being greater than a freezing temperature of water and a speed of the fan being less than a threshold speed, wherein the fan further comprises a motor coupled to the impeller and a control board in operative communication with the motor, the temperature sensor positioned on the control board of the fan.

10. The method of claim 9, wherein the temperature sensor comprises a thermistor.

11. The method of claim 9, wherein the refrigerator appliance further comprises an evaporator and a defrost heating element, the fan positioned adjacent at least one of the evaporator or the defrost heating element.

12. The method of claim 11, wherein said step of terminating the defrost cycle of the refrigerator appliance comprises deactivating the defrost heating element.

13. The method of claim 9, the motor of the fan is deactivated during said step of monitoring.

14. The method of claim 9, wherein the fan is positioned at a fresh food chamber, a freezer chamber or an ice box of the refrigerator appliance.

* * * * *